US011608835B2

(12) United States Patent
Yuan et al.

(10) Patent No.: US 11,608,835 B2
(45) Date of Patent: Mar. 21, 2023

(54) BLADE AND AXIAL FLOW IMPELLER USING SAME

(71) Applicants: York Guangzhou Air Conditioning and Refrigeration Co., Ltd., Qingyuan (CN); Johnson Controls Technology Company, Auburn Hills, MI (US)

(72) Inventors: Bin Yuan, Wuxi (CN); Chenggang Wu, Wuxi (CN); Xiaokui Ma, Wuxi (CN); Li Wang, Wuxi (CN); Jian Zhu, Wuxi (CN)

(73) Assignees: York Guangzhou Air Conditioning and Refrigeration Co., Ltd., Quingyuan (CN); Johnson Controls Tyco IP Holdings LLP, Milwaukee, WI (US)

( * ) Notice: Subject to any disclaimer, the term of this patent is extended or adjusted under 35 U.S.C. 154(b) by 0 days.

(21) Appl. No.: 17/229,662

(22) Filed: Apr. 13, 2021

(65) Prior Publication Data

US 2021/0317841 A1 Oct. 14, 2021

(30) Foreign Application Priority Data

Apr. 14, 2020 (CN) ..... 202010290698.0

(51) Int. Cl.
*F04D 29/38* (2006.01)
*F04D 29/66* (2006.01)

(52) U.S. Cl.
CPC ..... *F04D 29/384* (2013.01); *F04D 29/666* (2013.01)

(58) Field of Classification Search
CPC .... F04D 29/384; F04D 29/666; F04D 29/667; F04D 29/386; F05D 2240/307
See application file for complete search history.

(56) References Cited

U.S. PATENT DOCUMENTS

| | | | | |
|---|---|---|---|---|
| 10,400,604 | B2 * | 9/2019 | Sawada | F24F 13/24 |
| 2012/0207606 | A1 | 8/2012 | Stephan et al. | |
| 2019/0024674 | A1 * | 1/2019 | Loercher | F04D 29/30 |

FOREIGN PATENT DOCUMENTS

| | | | |
|---|---|---|---|
| CN | 201241864 Y | * | 5/2009 |
| CN | 201241864 Y | | 5/2009 |

(Continued)

OTHER PUBLICATIONS

European Search Report for EP Application No. 21167369.4, dated Sep. 13, 2021, 7 pgs.

*Primary Examiner* — Sabbir Hasan
(74) *Attorney, Agent, or Firm* — Fletcher Yoder, P.C.

(57) ABSTRACT

Disclosed in the present application is a blade and an axial flow impeller using same. The blade comprises a blade tip, a blade root, a leading edge, a trailing edge, an upper surface and a lower surface. The upper surface and lower surface are disposed opposite each other; the blade tip, the blade root, the leading edge and the trailing edge surround the upper surface and the lower surface, and connect the upper surface and the lower surface. The blade is rotatable about a rotation axis, the rotation axis being perpendicular to a normal plane. The blade tip comprises a blade tip base part and a blade tip trailing part, the blade tip base part being close to the leading edge, and the blade tip trailing part being close to the trailing edge and being bent upwards relative to the blade tip base part. An angle of attack of a chord of the blade tip trailing part is greater than an angle of attack of a chord of the blade tip base part, wherein the angle of attack is an acute included angle between the chord and the normal plane. The blade of the present application can provide a large air volume, and has higher static pressure and higher efficiency.

10 Claims, 8 Drawing Sheets

(56) References Cited

FOREIGN PATENT DOCUMENTS

| | | | |
|---|---|---|---|
| CN | 104389817 | A | 3/2015 |
| CN | 110939603 | A | 3/2020 |
| JP | 2017070337 | A | 4/2017 |

* cited by examiner

BLADE AND AXIAL FLOW IMPELLER USING SAME

CROSS-REFERENCE TO RELATED APPLICATIONS

This application claims priority from and the benefit of Chinese Patent Application No. 202010290698.0, filed Apr. 14, 2020, which is herein incorporated by reference in its entirety for all purposes.

TECHNICAL FIELD

The present application relates to the field of rotary machinery such as fans, pumps and compressors, in particular to a blade and an axial flow impeller using same.

BACKGROUND ART

The leading edge and trailing edge of a conventional blade are generally monotonous, smooth curves. Due to serious flow separation at the surface of the blade, vortices are formed, and consequently the blade has low aerodynamic performance and high noise.

SUMMARY OF THE INVENTION

Exemplary embodiments of the present application can solve at least some of the above-mentioned problems.

According to a first aspect of the present application, the present application provides a blade, comprising a blade tip, a blade root, a leading edge, a trailing edge, an upper surface and a lower surface. The upper surface and lower surface are disposed opposite each other; the blade tip, the blade root, the leading edge and the trailing edge surround the upper surface and the lower surface, and connect the upper surface and the lower surface. The blade is rotatable about a rotation axis, the rotation axis being perpendicular to a normal plane. The blade tip comprises a blade tip base part and a blade tip trailing part, the blade tip base part being close to the leading edge, and the blade tip trailing part being close to the trailing edge and being bent upwards relative to the blade tip base part. An angle of attack of a chord of the blade tip trailing part is greater than an angle of attack of a chord of the blade tip base part, wherein the angle of attack is an acute included angle between the chord and the normal plane.

In the blade according to the abovementioned first aspect, the upper surface extends smoothly from the blade tip to the blade root.

In the blade according to the abovementioned first aspect, the range of values of the angle of attack of the chord of the blade tip trailing part is greater than or equal to 200 and less than or equal to 30°.

In the blade according to the abovementioned first aspect, the proportion of the length of the blade tip taken up by the blade tip trailing part is greater than or equal to 1/12 and less than or equal to 1/8.

In the blade according to the abovementioned first aspect, a projection of the leading edge on the normal plane in the direction of the rotation axis is a first curve, and the first curve has an even number of inflection points.

In the blade according to the abovementioned first aspect, a line connecting any point on the first curve and the perpendicular foot is a first connecting line. A line connecting the perpendicular foot and a point of projection of the intersection point of the blade root and the leading edge on the normal plane in the direction of the rotation axis is a second connecting line. An included angle between the first connecting line and the second connecting line is called a leading edge angle θ. The leading edge angle θ of any point on the first curve satisfies $\theta \in [0°, 20°]$.

In the blade according to the abovementioned first aspect, the trailing edge is provided with multiple grooves, and a projection of the trailing edge on the normal plane in the direction of the rotation axis is a second curve, wherein an included angle between groove walls of each groove is a, a groove depth is H, and the length of the second curve is L.

The included angle and the groove depth satisfy:

$$\alpha \in [10°, 110°];$$

$$H = W \times L,\ W \in [1.5\%, 20\%].$$

In the blade according to the abovementioned first aspect, the included angle α between the groove walls of the groove closest to the blade tip in the multiple grooves satisfies: $\alpha \in [80°, 110°]$.

In the blade according to the abovementioned first aspect, the length of the trailing edge between groove walls of two adjacent said grooves is the same.

In the blade according to the abovementioned first aspect, on the trailing edge of the blade, the upper surface of the blade extends further than the lower surface in a circumferential direction, and a cross section of the trailing edge in the circumferential direction of the blade is arc-shaped.

According to a second aspect of the present application, the present application provides an axial flow impeller, comprising a hub and at least two blades according to the abovementioned first aspect. The hub has a rotation axis, the hub being rotatable about the rotation axis. The at least two blades are arranged on an outer circumferential face of the hub.

The blade of the present application can provide a large air volume, and has higher static pressure and higher efficiency.

BRIEF DESCRIPTION OF THE DRAWINGS

The features and advantages of the present application can be better understood by reading the following detailed description with reference to the drawings. In all of the drawings, identical reference labels indicate identical components, wherein.

DETAILED DESCRIPTION OF THE INVENTION

Figure 1:
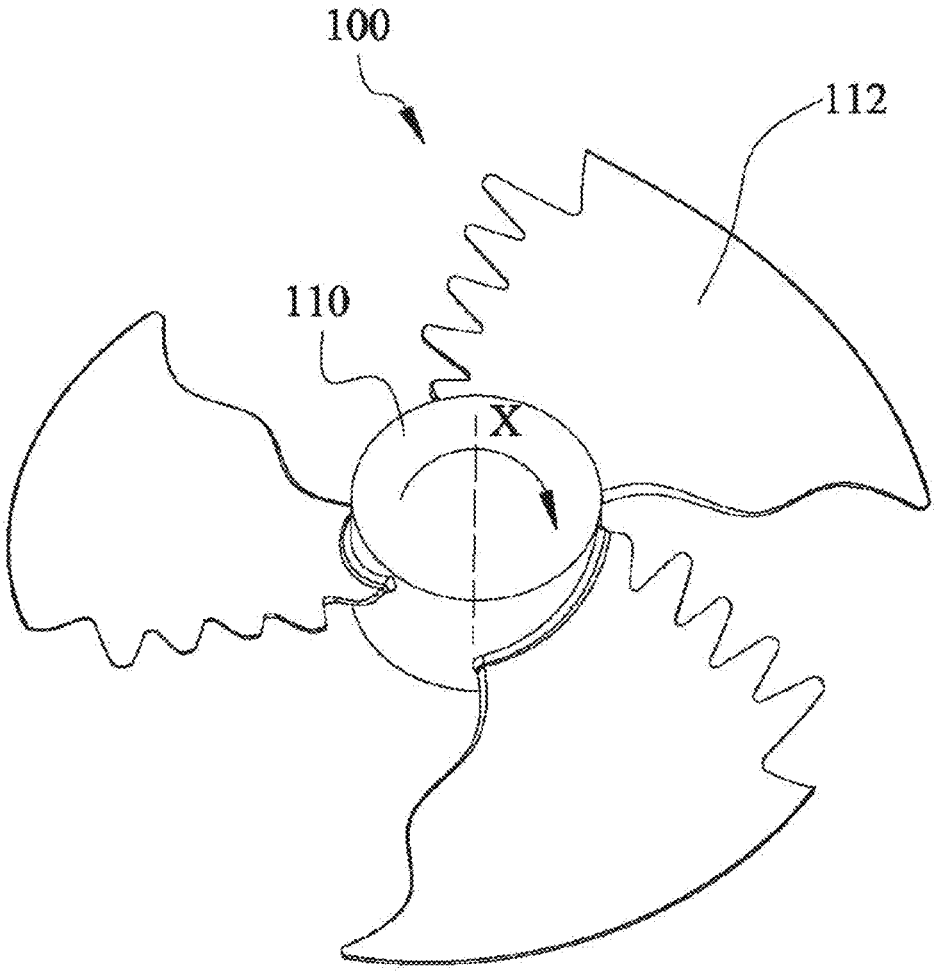
FIG. 1 shows a three-dimensional drawing of an axial flow impeller using the blade in an embodiment of the present application.

Various specific embodiments of the present application will be described below with reference to the drawings which form a part of this description. In the following drawings, identical parts and components are indicated by identical reference numerals.

FIG. 1 shows a three-dimensional drawing of an axial flow impeller 100 using the blade in an embodiment of the present application. As shown in FIG. 1, the axial flow impeller 100 comprises a hub 110 and three blades 112. The hub 110 has a rotation axis X: a cross section of the hub 110 perpendicular to the rotation axis X is circular. The three blades 112 are evenly arranged on an outer circumferential face of the hub 110, and are integrally connected to the hub 110. The hub 110 and the blades 112 may rotate about the rotation axis X together. As an example, the axial flow impeller 100 of the present application rotates around the rotation axis X clockwise (that is, in the rotation direction indicated by the arrow in FIG. 1). Those of ordinary skill in the art can understand that the hub 110 may also have another shape, and the number of blades 112 may be at least two. The hub 110 may be shaped in accordance with the number of blades 112. For example, when the number of blades 112 is three, the cross section of the hub 110 perpendicular to the rotation axis X is triangular; when the number of blades 112 is four, the cross section of the hub 110 perpendicular to the rotation axis X is quadrilateral.

Figure 2:
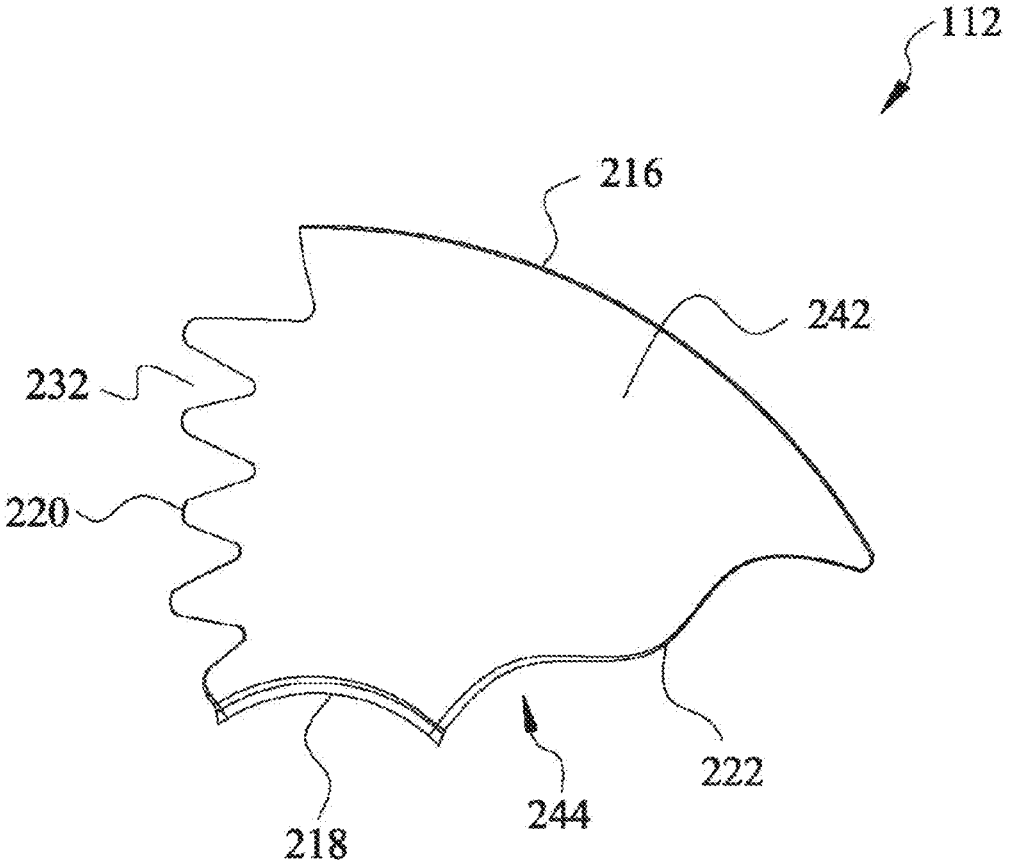
FIG. 2 shows a three-dimensional drawing of the blade used in the axial flow impeller in FIG. 1.

FIG. 2 shows a three-dimensional drawing of the blade 112 used in the axial flow impeller 100 in FIG. 1. As shown in FIG. 2, the blade 112 comprises an upper surface 242, a lower surface 244, a blade tip 216, a blade root 218, a leading edge 222 and a trailing edge 220. The upper surface 242 and lower surface 244 are disposed opposite each other. "Leading edge 222" refers to the front-end edge in the direction of blade rotation. "Trailing edge 220" refers to the rear-end edge in the direction of blade rotation. "Blade root 218" refers to an edge where the blade and the hub intersect. "Blade tip 216" refers to the other edge opposite the blade root. The blade tip 216, blade root 218, leading edge 222 and trailing edge 220 surround the upper surface 242 and the lower surface 244. That is to say, the upper surface 242 and the lower surface 244 each extend from the blade tip 216 to the blade root 218, and also each extend from the leading edge 222 to the trailing edge 220. The trailing edge 220 of the blade 112 of the present application is provided with multiple grooves 232, each of the multiple grooves 232 extending towards the leading edge 222.

Figure 3:
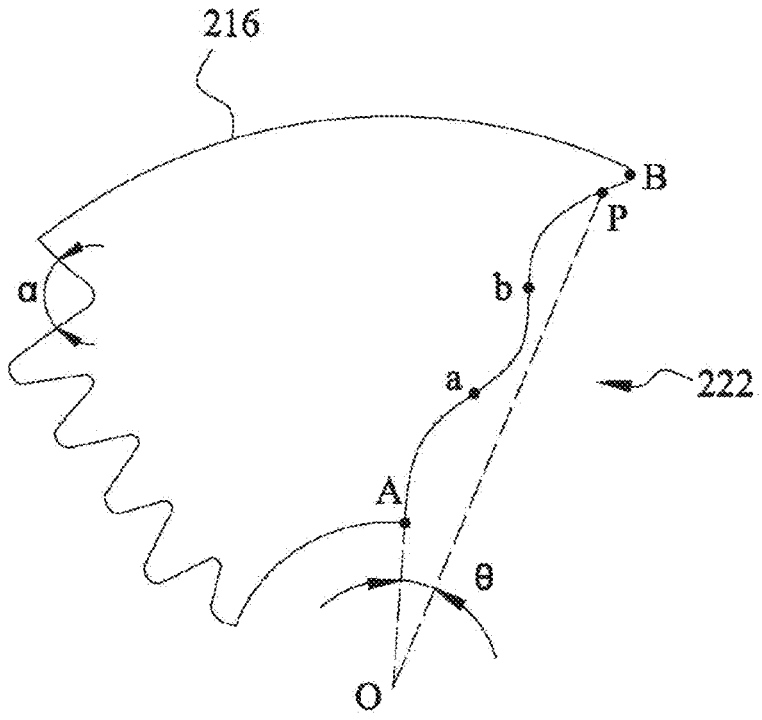
FIG. 3 shows a projection of the blade in FIG. 1 on a normal plane in the direction of a rotation axis X.

The axial flow impeller 100 has a normal plane (not shown) that is perpendicular to the rotation axis X, and the rotation axis X and the normal plane perpendicularly intersect at the perpendicular foot O (see FIG. 3). Those of ordinary skill in the art can understand that the normal plane is a virtual plane intended to better illustrate the specific structure of the blade 112.

FIG. 3 shows a projection of the blade 112 in FIG. 1 on the normal plane in the direction of the rotation axis X. A projection of the leading edge 222 of the blade 112 on the normal plane in the direction of the rotation axis X is a first curve, wherein the first curve has two inflection points a and b. The inflection points are demarcation points between concave arcs and convex arcs.

As shown in FIG. 3, the first curve has two inflection points, inflection point a and inflection point b. A point of projection of the intersection point of the blade root 218 and the leading edge 222 on the normal plane in the direction of the rotation axis X is a point A, and a point of projection of the intersection point of the blade tip 216 and the leading edge 222 on the normal plane in the direction of the rotation axis X is a point B. The curve from point A to inflection point a and the curve from inflection point b to point B are concave arcs; the curve from inflection point a to inflection point b is a convex arc. A point P is any point on the first curve, and a line connecting point P and the perpendicular foot O is a first connecting line. A line connecting point A and the perpendicular foot O is a second connecting line. An included angle between the first connecting line and the second connecting line is a leading edge angle θ. In an embodiment of the present application, the leading edge angle θ of any point P on the first curve satisfies $\theta \in [0°, 20°]$, and the line connecting any point P on the first curve and the perpendicular foot O is on the same side of the second connecting line.

Those skilled in the art will understand that the first curve in the present application can have any even number of inflection points, with no restriction to the two inflection points shown in the present application.

The inventors of the present application have found that when the leading edge angle θ satisfies $\theta \in [0°, 20°]$, the work length of the leading edge 222 having the concave arcs and convex arc can be increased effectively, thereby reducing the load on the leading edge 222 of the blade 112. When the blade 112 rotates, the concave arcs and convex arc on the leading edge 222 can forcibly split a large shed vortex that originally gathered on the upper surface of the blade 112 near the leading edge 222 into multiple small vortices, and as the blade 112 rotates, this causes the multiple small vortices to be located in a middle region of the blade 112 and at positions close to the trailing edge 220. Thus, the multiple small shed vortices located in the middle region of the blade 112 and at positions close to the trailing edge 220 can effectively reduce the intensity of turbulence as well as dissipation losses caused by turbulence, thus improving aerodynamic performance. As an example, the static efficiency value of a conventional blade is about 40%, whereas the static efficiency value of the blade 112 of the present application can reach 50%; this can effectively improve aerodynamic performance by 25%. In addition, when the multiple small vortices produced by splitting are flowing towards the trailing edge 220, they are not prone to mutual movement in the radial direction of the blade 112 to cause secondary flows, and relative speed flow lines of air on the surface of the blade 112 cross over each other as little as possible; thus, at the same time as the aerodynamic performance is improved, it is also possible to reduce noise. As an example, the blade 112 of the present application can reduce the noise value by 4 dB compared with a conventional blade (a reduction of 13%).

Figure 4:
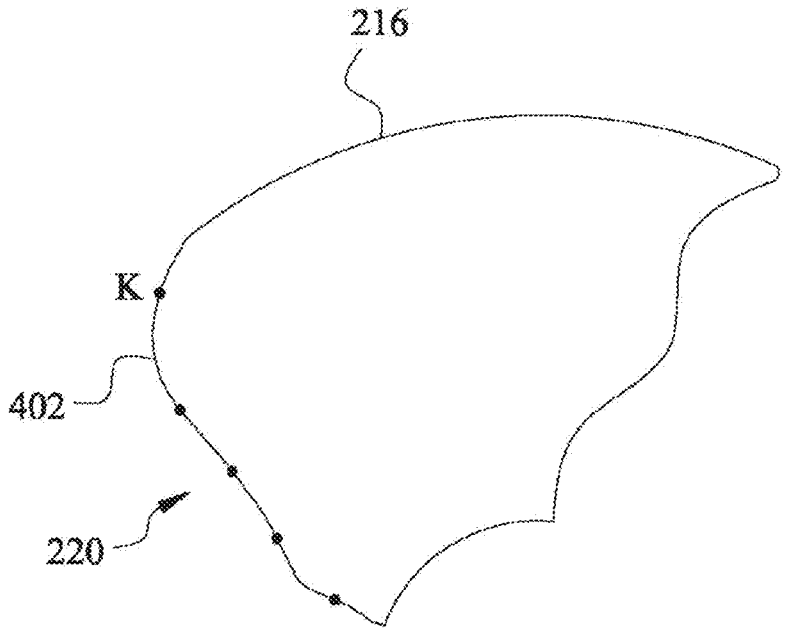
FIG. 4 is a projection, on the normal plane in the direction of the rotation axis X, of a blade whose trailing edge is not provided with multiple grooves.

FIG. 4 is a projection, on the normal plane in the direction of the rotation axis X. of a blade 112 whose trailing edge 220 is not provided with multiple grooves 232, and is intended to show multiple distribution points K of grooves 232. Multiple grooves 232 are provided according to the positions of the multiple distribution points K, thereby obtaining the blade 112 of FIG. 3, which has multiple grooves 232 provided on the trailing edge 220. As shown in FIG. 4, the trailing edge 220 has a contour line 402. The trailing edge 220 is provided with multiple grooves 232, each groove has a distribution point K. and the distribution point K of each groove is located on the contour line 402.

Figure 5A:
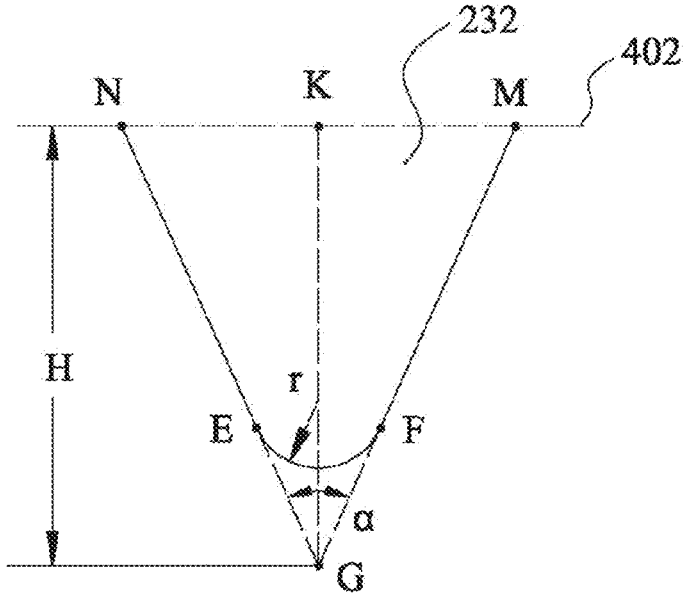
FIG. 5A is an enlarged projection of the groove shown in FIG. 2 on the normal plane in the direction of the rotation axis X.

FIG. 5A is an enlarged projection of the groove 232 shown in FIG. 2 on the normal plane in the direction of the rotation axis X. and is intended to show the specific structure of the groove 232. The shape of the groove 232 shown in FIG. 5A is determined on the basis of one distribution point K in FIG. 4. As shown in FIG. 4, the projection of the trailing edge 220 of the blade 112 without grooves on the normal plane in the direction of the rotation axis X is a second curve, and the length of the second curve is L. The groove 232 has a groove wall NE, a groove wall MF and a groove bottom EF. Lines of extension of the groove wall NE and groove wall MF intersect at a point G, and the groove wall NE and groove wall MF form an included angle α. A line connecting the distribution point K and point G is perpendicular to the tangent to the contour line 402 at the distribution point K. The line connecting the distribution point K and point G forms the groove depth H. The groove bottom EF is arc-shaped, and is tangent to the groove wall NE and the groove wall MF at a point E and a point F respectively.

As an example, a straight line perpendicular to the contour line 402 is drawn at the distribution point K, and the position of the bottom point G is determined according to the groove depth H. The groove depth H satisfies:

$$H=W\times L,\ W\in[1.5\%,20\%].$$

A groove wall line NG and a groove wall line MG form an included angle α, and the included angle α satisfies α∈[10°, 110°].

MN is the opening width of the groove 232. The groove bottom EF is arc-shaped, and has radius r. The groove bottom EF is tangent to the groove wall line NG and the groove wall line MG at points E and F, respectively, thereby forming the groove wall NE and groove wall MF. The radius r satisfies r∈[½₅H, ⅕H].

Figure 5B:
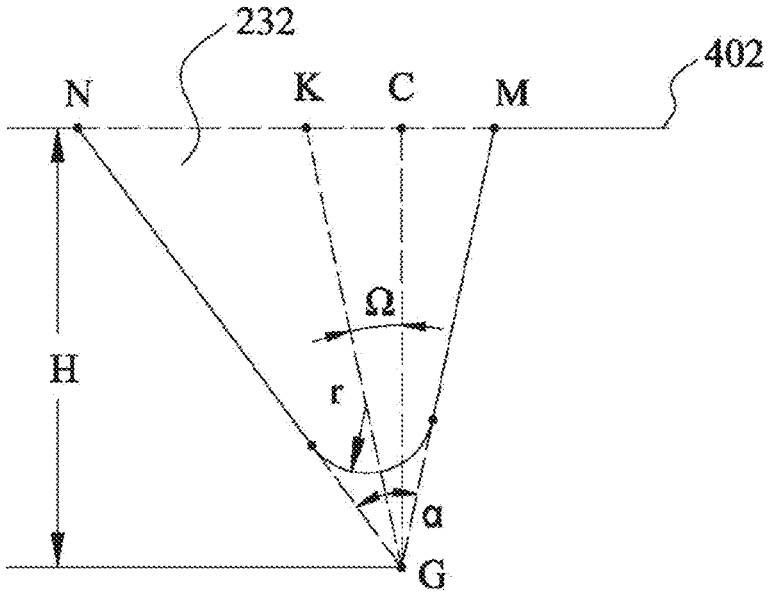
FIG. 5B is a schematic drawing of the specific structure of the groove in another embodiment of the present application.

FIG. 5B is a schematic drawing of the specific structure of the groove 232 in another embodiment of the present application. The groove 232 shown in FIG. 5B is substantially the same as the groove 232 shown in FIG. 5A, so a superfluous description is not given here. Unlike the groove 232 shown in FIG. 5A, a straight line perpendicular to the contour line 402 is drawn at a point C close to the distribution point K. and the position of the bottom point G is determined according to the groove depth H. The groove depth H satisfies:

$$H=W\times L,\ W\in[1.5\%,20\%].$$

A groove wall line NG and a groove wall line MG form an included angle α, and the included angle α satisfies α∈[10°, 110°].

In addition, an offset angle θ is formed between the straight line KG and the straight line CG; the offset angle Ω satisfies Ω∈[0°, 15°]. Point C may be at the left side of point K, or at the right side of point K.

As an example, the length of the trailing edge 220 between groove walls of adjacent grooves 232 is the same.

As another example, the multiple grooves 232 are configured such that the groove depths H thereof increase progressively by equal increments from the blade root 218 to the blade tip 216.

Continuing to refer to FIG. 3, in the present application, the groove 232 closest to the blade tip 216 is configured such that the included angle α satisfies α∈[80°, 110°].

The grooves 232 at the trailing edge 220 in the present application can reduce the power consumption of the blade 112.

Figure 6:
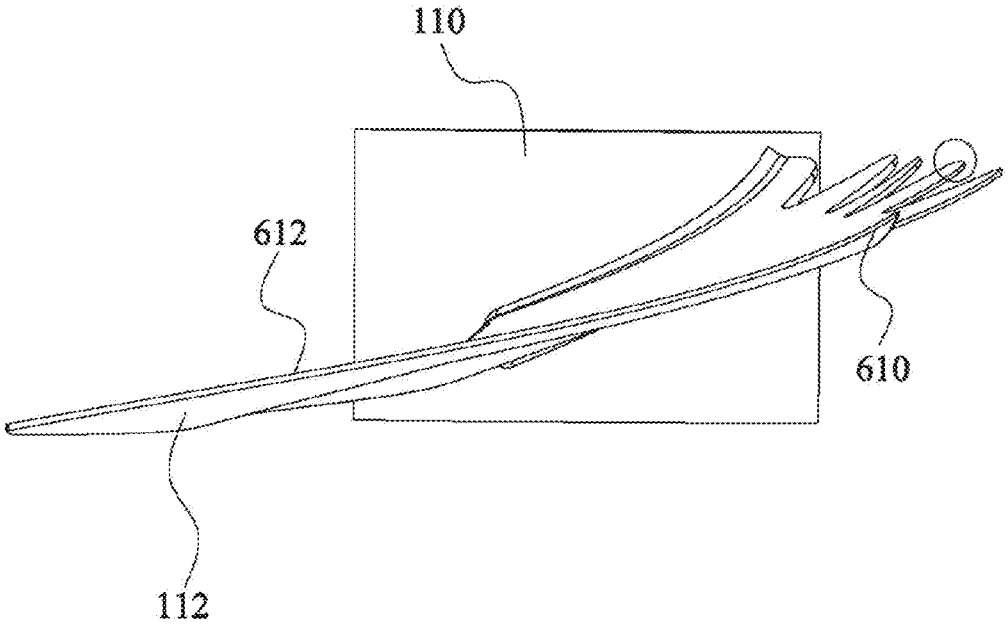
FIG. 6 is a side view of one of the blades and the hub in FIG. 1.
Figure 7:
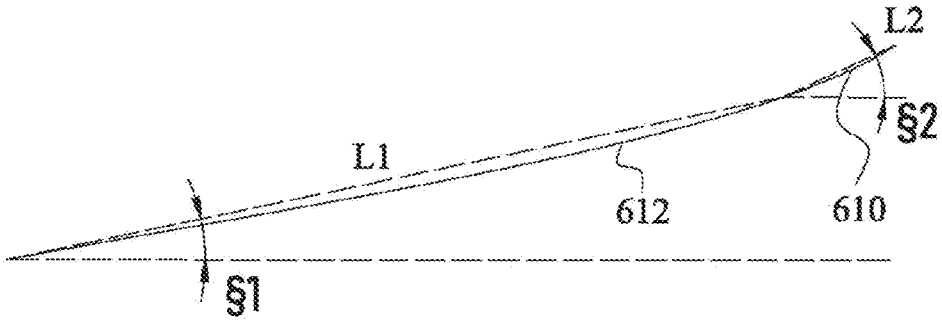
FIG. 7 is a simplified diagram showing the relationship of a blade tip trailing part shown in FIG. 6 to a blade tip base part.

FIG. 6 is a side view of one of the blades 112 and the hub 110 in FIG. 1, and is intended to show the specific structure of the blade tip 216. FIG. 7 is a simplified diagram showing the relationship of a blade tip trailing part 610 shown in FIG. 6 to a blade tip base part 612. As shown in FIGS. 6-7, the blade tip 216 comprises the blade tip base part 612 and the blade tip trailing part 610. The blade tip base part 612 and the blade tip trailing part 610 are smoothly connected, such that the blade 112 extends smoothly from the leading edge 222 to the trailing edge 220, and extends smoothly from the blade tip 216 to the blade root 218. That is to say, there is no inflection point between the blade tip base part 612 and the blade tip trailing part 610. The blade tip trailing part 610 is bent upwards relative to the blade tip base part 612. Specifically, a straight line connecting two ends of the blade tip base part 612 is a chord L1. A straight line connecting two ends of the blade tip trailing part 610 is a chord L2. An acute included angle between the chord and the normal plane perpendicular to the rotation axis X is an angle of attack §. The angle of attack § $_2$ of the chord L2 of the blade tip trailing part 610 is greater than the angle of attack § 1 of the chord L1 of the blade tip base part 612.

In the present application, the upward-bent structure of the blade tip trailing part 610 of the blade 112 has the advantage of reducing blade noise w % bile increasing blade air volume. Specifically, the inventors of the present application have found that in a conventional blade, when the blade rotates, vortices on the blade will be shed from the trailing edge. This rapid shedding of vortices will increase the vortex intensity, thereby causing an increase in noise. In the blade 112 of the present application, the upward-bent structure of the blade tip trailing part 610 is disposed close to the trailing edge 220, and will not cause an adverse effect whereby the leading edge 222 has a large load while the trailing edge 220 has a small load. The blade tip trailing part 610 close to the trailing edge 220 has maximum tangential speed (the speed in a direction perpendicular to the radial direction), and can split vortices at the trailing edge 220 so as to form smaller vortices, thereby delaying the shedding of vortices on the lower surface 244. This splitting into small vortices can effectively reduce noise and also improve sound quality.

In addition, the upward-bent structure of the blade tip trailing part 610 can increase the work angle of the blade 112 while causing virtually no additional force to the blade 112, and thereby increase the work done by the blade 112, so as to increase the air volume of the blade 112 and increase the static pressure.

It must be explained that while the upward-bent structure of the blade tip trailing part 610 is provided on the blade 112 of the present application, the multiple grooves 232 mentioned above are also provided at the trailing edge 220. In this case, the technical effect achieved by the grooves 232 will be added to the technical effect achieved by the blade tip trailing part 610, so that the air volume of the blade 112 can still be increased while reducing the work done by the blade 112. In other embodiments, either the upward-bent structure or the grooves may be provided alone.

As an example, the proportion of the length of the blade tip 216 taken up by the length of the blade tip trailing part 610 is greater than or equal to 1/12 and less than or equal to 1/8.

As another example, the angle of attack $\S_1$ of the chord L1 of the blade tip trailing part 610 satisfies: $\S_1$ E [20°, 30°].

Figure 8A:
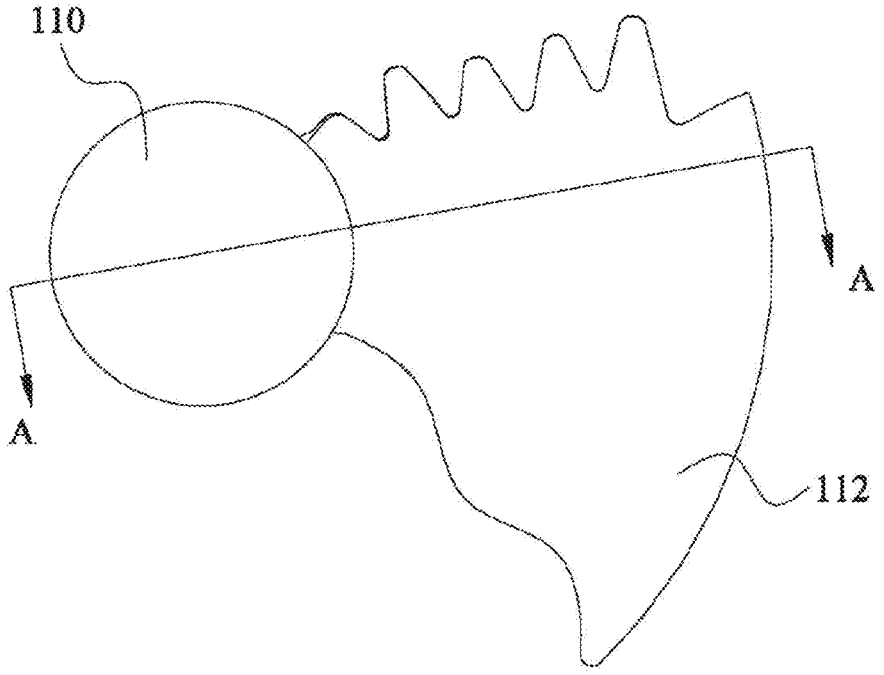
FIG. 8A is a top view of one of the blades and the hub in FIG. 1.
Figure 8B:
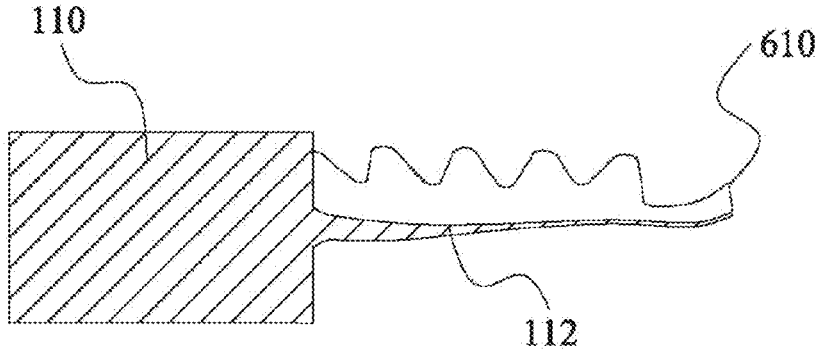
FIG. 8B is a section taken along a line A-A in FIG. 8A.

FIG. 8A is a top view of one of the blades 112 and the hub 110 in FIG. 1. FIG. 8B is a section taken along a centre line A-A of the blade 112 and hub 110 in FIG. 8A. It can be seen from FIGS. 8A-8B that the blade tip 216 of the blade 112 has the blade tip trailing part 610. The upper surface 242 of the blade 112 extends smoothly from the blade root 218 to the blade tip 216.

Figure 9:
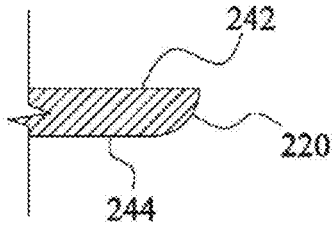
FIG. 9 is a sectional drawing of the trailing edge of the blade in a circumferential direction.

FIG. 9 is a sectional drawing of the trailing edge 220 of the blade 112 in a circumferential direction. As an example, FIG. 9 shows a sectional drawing of the trailing edge 220 within the circle in FIG. 6 in the circumferential direction. As shown in FIG. 9, the trailing edge 220 and the lower surface 244 form a bevel. Specifically, the upper surface 242 extends further than the lower surface 244. The trailing edge 220 connects the upper surface 242 and the lower surface 244, and the trailing edge 220 is smoothly connected to the lower surface 244. As an example, a circumferential section of the trailing edge 220 is arc-shaped.

The inventors of the present application have found that, compared with a conventional blade having a trailing edge and lower surface that do not form a bevel, the efficiency of a blade 112 having a trailing edge 220 that forms a bevel with the lower surface 244 can be increased by about 4%, and noise can be reduced by about 12%.

Figure 10:
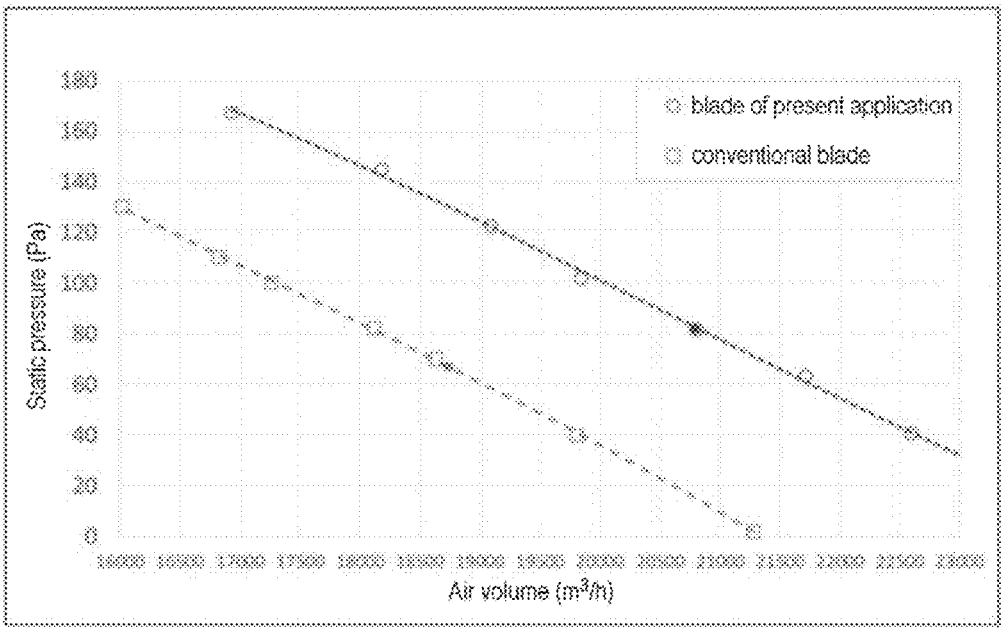
FIG. 10 is a graph of the relationship between static pressure and air volume, for the blade of the present application and a conventional blade.

FIG. 10 is a graph of the relationship between static pressure and air volume, for the blade 112 of the present application and a conventional blade. It can be seen from FIG. 10 that, for the same air volume, the static pressure of the blade of the present application is higher than the static pressure of the conventional blade by approximately 60 pa, so the blade of the present application can satisfy application scenarios with higher static pressure requirements.

Figure 11:
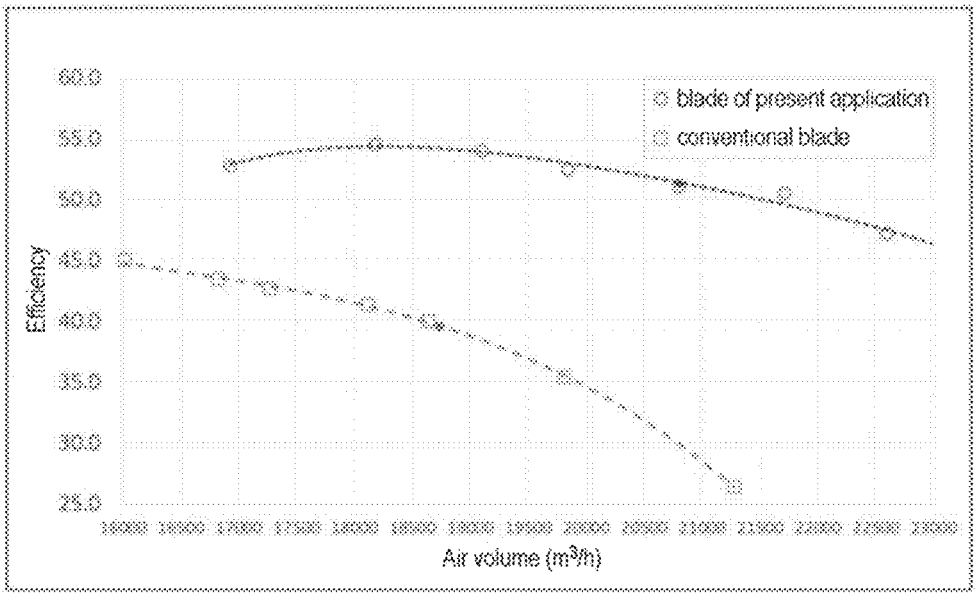
FIG. 11 is a graph of the relationship between efficiency and air volume, for the blade of the present application and a conventional blade.

FIG. 11 is a graph of the relationship between efficiency and air volume, for the blade 112 of the present application and a conventional blade. It is clear from FIG. 11 that for the same air volume, the efficiency of the blade of the present application is higher than that of the conventional blade. In particular when the air volume increases, the efficiency of the blade 112 of the present application does not fall by much, whereas the efficiency of the conventional blade falls more quickly.

Figure 12:
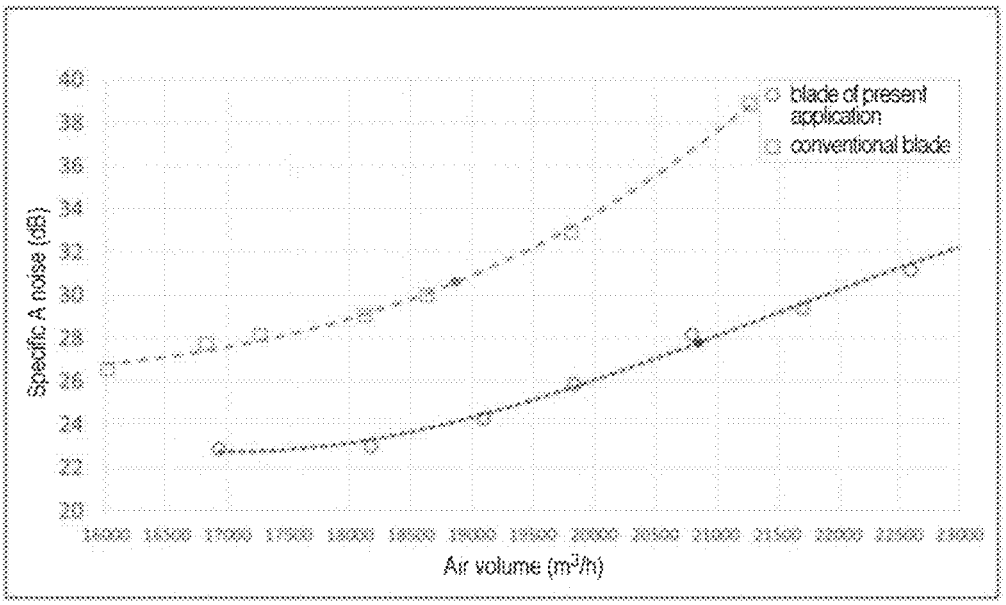
FIG. 12 is a graph of the relationship between noise and air volume, for the blade of the present application and a conventional blade.

FIG. 12 is a graph of the relationship between noise and air volume, for the blade 112 of the present application and a conventional blade. It is clear from FIG. 12 that for the same air volume, the noise of the blade of the present application is lower than that of the conventional blade. In addition, the noise sound quality produced by the blade 112 of the present application is superior to that produced by the conventional blade.

Moreover, it can also be seen from FIGS. 10-12 that for the same input power, the range of air volumes that the blade 112 of the present application is able to provide is higher, specifically 17000 $m^3$/h-23000 $m^3$/h, so the blade of the present application can satisfy application scenarios with higher air volume requirements.

It must be explained that a blade profile cross section of the blade 112 from the leading edge to the trailing edge may be of various types; it may be a cross section of equal thickness or any two-dimensional airfoil profile.

Although only some characteristics of the present application are shown and described herein, those skilled in the art can make various improvements and modifications. Therefore, it should be understood that the attached claims are intended to cover all of the above-mentioned improvements and modifications falling within the scope of the substantive spirit of the present application.

The invention claimed is:

1. A blade, comprising:

a blade tip, a blade root, a leading edge, a trailing edge, an upper surface and a lower surface, the upper surface and the lower surface being disposed opposite each other; the blade tip, the blade root, the leading edge, and the trailing edge surrounding the upper surface and the lower surface, and connecting the upper surface and the lower surface; and the blade being rotatable about a rotation axis, the rotation axis being perpendicular to a normal plane;

characterized in that:

the blade tip comprises a blade tip base part and a blade tip trailing part, the blade tip base part extending from the leading edge, and the blade tip trailing part extending from the trailing edge and being bent upwards relative to the blade tip base part;

wherein an angle of attack of a chord of the blade tip trailing part is greater than an angle of attack of a chord of the blade tip base part, wherein the trailing edge is provided with multiple grooves, and a projection of the trailing edge on the normal plane in a direction of the rotation axis is a second curve, wherein an included angle between groove walls of each groove is a, a groove depth is H, and a length of the second curve is L, and wherein the included angle and the groove depth satisfy, respectively:

$$\alpha \in [10°, 110°];$$

$$H = W \times L,\ W \in [1.5\%, 20\%].$$

2. The blade of claim 1, characterized in that: the upper surface extends smoothly from the blade tip to the blade root.

3. The blade of claim 1, characterized in that:

a range of values of the angle of attack of the chord of the blade tip trailing part is greater than or equal to 20° and less than or equal to 30°.

4. The blade of claim 1, characterized in that:

a proportion of a length of the blade tip taken up by the blade tip trailing part is greater than or equal to 1/12 and less than or equal to 1/8.

5. The blade of claim 1, characterized in that:

a projection of the leading edge on the normal plane in the direction of the rotation axis is a first curve, and the first curve has an even number of inflection points;

the rotation axis and the normal plane perpendicularly intersect at a perpendicular foot;

a line connecting any point on the first curve and the perpendicular foot is a first connecting line;

a line connecting the perpendicular foot and a point of projection of an intersection point of the blade root and the leading edge on the normal plane in the direction of the rotation axis is a second connecting line;

an included angle between the first connecting line and the second connecting line is a leading edge angle θ; and the leading edge angle θ of any point on the first curve satisfies $\theta \in [0°, 20°]$.

6. The blade of claim 1, characterized in that:

the included angle α between the groove walls of a groove closest to the blade tip in the multiple grooves satisfies: $\alpha \in [80°, 110°]$.

7. The blade of claim 1, characterized in that:

a length of the trailing edge between groove walls of two adjacent grooves is the same.

8. The blade claim 1, characterized in that:

on the trailing edge of the blade, the upper surface of the blade extends further than the lower surface in a circumferential direction, and a cross section of the trailing edge in the circumferential direction of the blade is arc-shaped.

9. An axial flow impeller, comprising:

a hub, the hub having a rotation axis, the hub being rotatable about the rotation axis; and at least two blades, the at least two blades being arranged on an outer circumferential face of the hub, wherein each blade of the at least two blades comprises:

a blade tip, a blade root, a leading edge, a trailing edge, an upper surface, and a lower surface, the upper surface and the lower surface being disposed opposite each other; the blade tip, the blade root, the leading edge, and the trailing edge surrounding the upper surface and the lower surface and connecting the upper surface and the lower surface, and the blade being rotatable about the rotation axis, the rotation axis being perpendicular to a normal plane;

characterized in that:

the blade tip comprises a blade tip base part and a blade tip trailing part, the blade tip base part extending from the leading edge, and the blade tip trailing part extending from the trailing edge and being bent upwards relative to the blade tip base part;

wherein an angle of attack of a chord of the blade tip trailing part is greater than an angle of attack of a chord of the blade tip base part, wherein the trailing edge is provided with multiple grooves, and a projection of the trailing edge on the normal plane in a direction of the rotation axis is a second curve, wherein an included angle between groove walls of each groove is a, a groove depth is H, and a length of the second curve is L, and wherein the included angle and the groove depth satisfy, respectively:

$$\alpha \in [10°, 110°];$$

$$H = W \times L,\ W \in [1.5\%, 20\%].$$

10. A blade, comprising:

a blade tip, a blade root, a leading edge, a trailing edge, an upper surface, and a lower surface, the upper surface and the lower surface being disposed opposite each other; the blade tip, the blade root, the leading edge, and the trailing edge surrounding the upper surface and the lower surface and connecting the upper surface and the lower surface, and the blade being rotatable about a rotation axis, the rotation axis being perpendicular to a normal plane;

characterized in that:

the blade tip comprises a blade tip base part and a blade tip trailing part, the blade tip base part extending from the leading edge, and the blade tip trailing part extending from the trailing edge and being bent upwards relative to the blade tip base part;

wherein an angle of attack of a chord of the blade tip trailing part is greater than an angle of attack of a chord of the blade tip base part, and wherein, on the trailing edge of the blade, the upper surface of the blade extends further than the lower surface in a circumferential direction, and a cross section of the trailing edge in the circumferential direction of the blade is arc-shaped.

* * * * *